US012729029B2

(12) United States Patent
Oymann et al.

(10) Patent No.: US 12,729,029 B2
(45) Date of Patent: Sep. 8, 2026

(54) DEVICE FOR INSERTING APERTURE IN PART-REGION OF FILM WRAPPING OF GOODS STACK ARRANGED ON PALLET, WHERE FILM WRAPPING IS CONFIGURED AS FILM HOOD DRAWN OVER GOODS STACK OR AS FILM SLEEVE SURROUNDING GOODS STACK AT LEAST IN PART

(71) Applicant: MSK—Verpackungs-Systeme GmbH, Kleve (DE)

(72) Inventors: Michael Oymann, Xanten (DE); Enrico Czok, Kleve (DE)

(73) Assignee: MSK—Verpackungs-Systeme GmbH, Kleve (DE)

( * ) Notice: Subject to any disclaimer, the term of this patent is extended or adjusted under 35 U.S.C. 154(b) by 0 days.

(21) Appl. No.: 18/411,273

(22) Filed: Jan. 12, 2024

(65) Prior Publication Data

US 2024/0228098 A1 Jul. 11, 2024

Related U.S. Application Data

(62) Division of application No. 17/552,623, filed on Dec. 16, 2021, now Pat. No. 12,012,247.

(30) Foreign Application Priority Data

Dec. 18, 2020 (EP) ..... 20215597

(51) Int. Cl.
*B65B 69/00* (2006.01)

(52) U.S. Cl.
CPC ..... *B65B 69/0041* (2013.01); *B65B 69/0033* (2013.01); *B65H 2701/1944* (2013.01)

(58) Field of Classification Search
CPC ..... B65B 69/0025; B65B 69/0033; B65B 69/0041; B65B 61/18; B65H 2701/1944
See application file for complete search history.

(56) References Cited

U.S. PATENT DOCUMENTS 3,035,381 A * 5/1962 Hosso ..... B65B 25/20 493/203
4,160,563 A * 7/1979 Whitney ..... B25J 1/04 294/104

(Continued)

FOREIGN PATENT DOCUMENTS

CN 106956835 A * 7/2017 ..... B65B 69/0033
DE 1511847 A1 1/1970

(Continued)

OTHER PUBLICATIONS

European Search Report in Related Application No. 20215597.4 dated Jun. 9, 2021.

*Primary Examiner* — Joshua G Kotis
(74) *Attorney, Agent, or Firm* — CALDERON SAFRAN & WRIGHT P.C.

(57) ABSTRACT

A device for inserting an aperture in a film wrapping of a goods stack arranged on a pallet, where the film wrapping is a film hood drawn over the goods stack or as a film sleeve surrounding the goods stack is disclosed.
A piercing element has a rotatably attached actuation arm. The piercing element exhibits first and second part-regions. The first part-region is mounted rotatably on the actuation arm and the second part-region includes the piercing region. The second part-region is pivotable relative to the first part-region from an original position against a restoring force. A corresponding system and a method for inserting an aperture in a part-region of a film wrapping of a goods stack arranged on a pallet is disclosed, where the film wrapping is (Continued)

configured as a film hood drawn over the goods stack or as a film sleeve surrounding the goods stack.

13 Claims, 11 Drawing Sheets

(56) References Cited

U.S. PATENT DOCUMENTS 4,553,312 A * 11/1985 Mitzel ..... B65B 69/0025 83/924
5,103,684 A * 4/1992 Denton ..... G01N 1/04 30/301
5,179,878 A 1/1993 Kranefeld et al.
5,190,430 A * 3/1993 Neri ..... B65B 43/185 414/412
5,463,841 A 11/1995 Hayakawa et al.
5,596,866 A * 1/1997 Martin-Cocher ..... B65B 53/066 53/442
5,727,747 A 3/1998 Hannen et al.
5,765,344 A * 6/1998 Mandeville ..... B65B 11/025 53/556
5,931,071 A * 8/1999 Mori ..... B25J 11/0055 83/76
5,964,388 A * 10/1999 Jennings ..... B26B 27/00 30/2
7,174,695 B2 * 2/2007 Porter ..... B65B 69/0025 53/399
8,277,282 B2 * 10/2012 Tanaka ..... B26D 3/10 451/72
9,272,804 B2 3/2016 Pippin
2004/0099110 A1 * 5/2004 Cere ..... B65B 69/0033 83/559
2005/0204567 A1 * 9/2005 Ping ..... B26B 1/042 30/161
2007/0095187 A1 * 5/2007 Spaans ..... B65B 69/0025 83/567
2007/0101680 A1 * 5/2007 Murarotto ..... B26D 5/02 53/399
2007/0220830 A1 * 9/2007 Macleod ..... B65B 31/00 53/556
2007/0237434 A1 10/2007 Mckellar
2008/0216450 A1 * 9/2008 MacLeod ..... B65B 11/045 53/287
2012/0096817 A1 * 4/2012 Dickerson ..... B26F 3/00 53/381.1
2015/0000491 A1 * 1/2015 Figiel ..... B65B 69/0025 83/385
2015/0166209 A1 * 6/2015 Curles ..... B65B 69/0033 414/412
2017/0064908 A1 * 3/2017 Sell ..... B26D 3/08
2019/0023442 A1 * 1/2019 Gibert Guasch ... B65B 69/0033
2022/0111538 A1 * 4/2022 Tsujimori ..... B25J 15/0071
2022/0194647 A1 6/2022 Oymann et al.
2022/0306332 A1 * 9/2022 Jarr ..... B26D 7/0006
2023/0159208 A1 * 5/2023 Bjerring ..... B65B 69/00 53/492

FOREIGN PATENT DOCUMENTS

DE 4311421 A1 * 10/1994 ..... B29B 17/02
EP 0142846 A1 * 5/1985 ..... B65B 69/0033
EP 812769 A1 * 12/1997 ..... B65B 69/00
EP 1449771 A1 * 8/2004 ..... B65B 11/025
EP 1580128 A1 * 9/2005 ..... B65B 9/135
IT 201900002579 A1 * 8/2020 ..... B65B 11/585
IT 102020000011878 B1 * 6/2022
KR 20190049142 A * 5/2019 ..... B26D 7/1863
WO WO-0210022 A1 * 2/2002 ..... B65B 69/0033
WO 2004007295 A1 1/2004
WO 2011012658 A1 2/2011

* cited by examiner

DEVICE FOR INSERTING APERTURE IN PART-REGION OF FILM WRAPPING OF GOODS STACK ARRANGED ON PALLET, WHERE FILM WRAPPING IS CONFIGURED AS FILM HOOD DRAWN OVER GOODS STACK OR AS FILM SLEEVE SURROUNDING GOODS STACK AT LEAST IN PART

CROSS-REFERENCE TO RELATED APPLICATIONS AND CLAIM TO PRIORITY

This application is a divisional of U.S. patent application Ser. No. 17/552,623, filed Dec. 16, 2021, and is related to application Ser. No. 20/215,597.4, filed Dec. 18, 2020, in the European Patent Office, the disclosures of which are incorporated herein by reference and to which priority is claimed.

FIELD OF THE INVENTION

The invention concerns a device for inserting an aperture in a part-region of a film wrapping of a goods stack preferably arranged on a pallet, where the film wrapping comprises a film hood drawn over the goods stack and possibly a bottom film sheet arranged underneath the goods stack or the film wrapping comprises a film sleeve surrounding the goods stack at least in part and possibly a bottom film sheet arranged underneath the good stack, a) Where the film wrapping is welded with a bottom film sheet situated underneath the goods stack, forming a weld seam horizontally encircling the goods stack, and Either The aperture is inserted in the weld seam or else The aperture is inserted in the region of the bottom film sheet surrounding the goods stack, preferably adjacent to the weld seam or b) Where the film wrapping exhibits a collar shrinkage encircling the goods stack horizontally, preferably oriented horizontally, and the aperture is inserted in the collar shrinkage or c) Where the film wrapping exhibits a collar stretch encircling the goods stack horizontally, preferably horizontally oriented, and the aperture is inserted in the collar stretch, Where the device comprises a piercing element with a piercing region and at least one actuation arm, to which the piercing element is attached rotatably about a rotation axis.

BACKGROUND OF THE INVENTION

A film sleeve is configured as open above and below. A film hood encloses a goods stack on five sides in total. The film hood can involve a shrinkage or stretch hood made of film. If a goods stack is set down directly on a pallet, then for good securing of the load the film hood preferably envelops with its lower encircling margin a part-region of the pallet. In the case of a shrinkage hood, the lower marginal region is heated, forming what is known as a collar shrinkage. In the case of a stretch film, the stretched film hood is slipped over in such a way that the stretch film abuts on the pallet, forming a collar stretch at least in the upper region.

Both in the region of the collar stretch and that of the collar shrinkage, several film layers lie over each other. Therefore, these regions are significantly thicker and in part also firmer than the rest of the regions of the film hood. The collar stretch and the collar shrinkage abut tightly and tautly on the outside of the upper board of the pallet.

If wrapping a goods stack on six sides in total is intended, a bottom film sheet is first laid on a pallet and the goods stack placed on it. After drawing the film hood over the goods stack, the film hood is welded with the bottom film sheet all round, forming a weld seam. In the case of a weld seam, film removal is hindered for example by heavy material accumulation, e.g. in the form of bulges made of molten and resolidified synthetic, or a bottom film sheet which is thick compared with the film hood, or a bottom film sheet welded with several film hoods.

For later unpacking, i.e. film removal, the film hood has to be separated vertically in at least one place so that subsequently the film hood can be pulled off. In goods stacks packaged in this manner, however, automated film removal is hampered because of the weld seam or the collar shrinkage or the collar stretch. In this region the film hood is attached strongly to the contour of the pallet, such that in this region it is not accessible to known film removal methods. Depending on the deployed thickness of the film, for example for the bottom film sheet and for the film hood, the weld seam and/or the film bulge respectively made of welded film material created during welding can be so strong and thick that with the devices known thus far, clean separation of the film hood with the weld seam and/or the film bulge respectively from the bottom film sheet is not possible.

For film removal, therefore, first the weld seam or the collar shrinkage or the collar stretch has to be provided with an aperture, so that the weld seam or the collar shrinkage or the collar stretch is open in one place. To this end, a device is used which comprises an actuation arm to which a rotatably mounted piercing element with a piercing region is attached. The piercing element is inserted between the goods stack and the film hood through an insertion aperture. In order to facilitate the insertion, the film hood in the side region concerned is first pulled away from the goods stack and held in the pulled-away position. After inserting the piercing element into the gap, the piercing element is moved vertically downward.

By means of such a known device, an aperture can indeed be inserted. However, the inserted aperture is not situated in the region of the weld seam or the collar shrinkage or the collar stretch, but rather at a distance from the weld seam or the collar shrinkage or the collar stretch within the lateral surface of the film hood. As a result, part of the film hood remains on the pallet. So that automated film removal can take place, cost- and time-intensive manual post-processing is required. Otherwise problems can occur during subsequent procedures, such as e.g. during transportation, during depalletizing, and during storage, for example in high-rack warehouses, if the residual parts of the film hood are not removed.

SUMMARY OF THE INVENTION

The task of the invention, therefore, is to avoid the aforementioned drawbacks and propose a device by means of which an aperture can be inserted in a weld seam, in a region of a bottom film sheet surrounding the goods stack, in a collar stretch, or in a collar shrinkage of a film wrapping.

This task is solved by the piercing element exhibiting a first part-region and a second part-region, where the first part-region is mounted rotatably on the actuation arm and where the second part-region exhibits the piercing region and where the second part-region is pivotable relative to the first part-region in at least one direction from an original position against a restoring force. During operation of the invention's device, the rotation axis of the piercing element is oriented orthogonally to the lateral surface concerned of the goods stack, where the aperture is to be inserted. The first part-region of the piercing element can also involve the mounting of the piercing element itself.

The film hood configured as film wrapping, or the film sleeve configured as film wrapping and surrounding the goods stack at least in part, extends at least to the bottom edge of the goods stack. The film wrapping can, however, also project on the underside relative to the underside of the goods stack. Such configuration can be useful when the goods stack is set down on a pallet and a collar shrinkage enveloping the pallet is provided.

The collar shrinkage and/or the collar stretch respectively can abut tightly and tautly on the outside of the goods stack or of the pallet. In such a case, the collar shrinkage and/or the collar stretch respectively are oriented vertically. It is, however, also quite possible for the collar shrinkage or the collar stretch to engage from underneath a part-region of the pallet, for example the marginal region of the upper board layer of the pallet. In that case, the collar shrinkage and/or the collar stretch respectively is at least in part also oriented horizontally.

During the downward displacement in subsequent operation, the first part-region remains in a vertical plane spanned by the downward movement. Due to the pivotable configuration of the second part-region, however, the second part-region can assume the contour of a film wrapping pulled-away from a goods stack, i.e. the second part-region travels along on the inside of the film wrapping and is guided by the film wrapping exactly to the desired region where the weld seam or the region of a bottom film sheet surrounding the goods stack or the collar shrinkage or the collar stretch is to be pierced.

If for example, as film wrapping, a film hood is welded with a bottom film sheet situated underneath the goods stack, forming a weld seam horizontally encircling the goods stack, by means of the invention's device either the weld seam can be pierced between the bottom film sheet and the film hood, or alternatively the bottom film sheet can be pierced between the weld seam and the load (goods stack) and/or the pallet respectively, such that thereby the weld seam and/or the welded film bulge respectively can be pulled away so far from the load (goods stack) and/or the pallet respectively that it is possible to separate the weld seam and/or the welded film bulge respectively in a subsequent step, for example by means of a vertical separating device.

The first part-region and the second part-region can be connected with each other via a joint.

The first part-region and the second part-region can be connected with each other via a spring joint.

Here the piercing element can be configured in the manner of a blade.

In the original position, i.e. in the non-pivoted state, the first part-region and the second part-region can be in alignment with each other.

Here the edge of the free end of the second part-region, i.e. the edge of the end of the second part-region that lies opposite to the first part-region, can be configured at least in part beveled or rounded in the direction in which the second part-region is pivotable against the restoring force. This beveled or rounded configuration prevents the piercing element damaging the film wrapping during the downward displacement when the piercing element is in contact with the inside of the film wrapping during the downward displacement. Furthermore, the rounding and the beveling improve the following of the contour of the film wrapping. In the case of a beveled or rounded edge, pivoting of the second part-region is possible only in the direction of the course of the applicable edge.

In doing so, the edge of the free end of the second part-region, i.e. the edge of the end of the second part-region that lies opposite to the first part-region, and/or the surface of the second part-region interacting with the inside of a film wrapping, can exhibit a friction-minimizing coating and/or a friction-minimizing surface. Thereby during the downward displacement, the film hood can abut with its inside on the piercing element without the film hood being damaged during the downward displacement.

The free end of the second part-region, i.e. the end of the second part-region that lies opposite to the first part-region, can exhibit in the piercing region an overhang projecting relative to the edge. The overhang extends in the plane of the second part-region. Through the overhang there is first inserted a small aperture, through which then subsequently the piercing element is passed with its complete piercing region.

The actuation arm can exhibit, adjacent to the rotation axis around which the piercing element is rotatably mounted, at least one cutting blade extending in parallel to the rotation axis and oriented orthogonally to the actuation arm, which is arranged in such a way on the actuation arm that after piercing, preferably during the downward displacement, the cutting blade is arranged on the side of the actuation arm pointing downward. By means of the cutting blade, material accumulation remaining at the lower margin of the film wrapping can be cut through.

Here the cutting blade can be formed by two cutting blade part-regions oriented obliquely to each other and forming between them a funnel-shaped insertion region. Due to the funneled converging insertion region, during the displacement of the actuation arm the margin that is to be cut through is moved along the obliquely oriented cutting edge and in this way separated.

The invention also concerns a system comprising a goods stack, preferably arranged on a pallet, with a film wrapping, where the film wrapping comprises a film hood drawn over the goods stack and possibly a bottom film sheet arranged underneath the goods stack, or the film wrapping comprises a film sleeve surrounding the goods stack at least in part and possibly a bottom film sheet arranged underneath the goods stack, a) Where the film wrapping is welded with a bottom film sheet situated underneath the goods stack, forming a weld seam encircling the goods stack horizontally, and Either The aperture is inserted in weld seam or else The aperture is inserted in the region of the bottom film sheet surrounding the goods stack, preferably adjacent to the weld seam or b) Where the film wrapping exhibits a collar shrinkage encircling the goods stack horizontally, preferably oriented horizontally, and the aperture is inserted in the collar shrinkage or c) Where the film wrapping exhibits a collar stretch encircling the goods stack horizontally, preferably oriented horizontally, and the aperture is inserted in the collar stretch, and at least one device comprising a piercing element with a piercing region and at least one actuation arm, to which the piercing element is attached rotatably about a rotation axis, where the device is configured according to one of the Claims and where by means of this device an aperture can be inserted in the weld seam or in the region of a bottom film sheet surrounding the goods stack or in the collar shrinkage or in the collar stretch.

The device is arranged for example adjacent to a conveyor on which the goods stack to be unpacked is transported inward. Advantageously the device is arranged for example on a sled which is moveable orthogonally to the conveyor's route. In this way the device can be adapted to different pallet formats. It can be useful if the actuation arm exhibits several joints. Thereby the piercing element can be moved to the desired point in order subsequently to insert the desired aperture.

Here the system can exhibit a rack and a carrier arm, mounted on it rotatably about a vertical axis and drivable about the axis, for a winding mandrel suspended on it, where on the carrier arm there is arranged a guide sled which is relocatable in its longitudinal direction and on the guide sled there are suspended the winding mandrel and a guide pole extending parallel thereto, and at the guide pole there can be guided a vertically relocatable lifting sled with a suction device connectable to a negative pressure device for area-by-area lifting of the film hood from the goods stack and with a separating device which separates a preferably rectangular film flap from the film hood, and a further separating device can be provided for a vertical separating cut. Thus by means of the separating device, three cuts forming a U can be inserted in the film hood. In this way, a rectangular film flap is detached from the film hood. The separating device can be for example a U-shaped heated wire.

Here the further separating device can be a knife moveable with a drive along the guide pole.

Alternatively, the further separating device can be a heated wire extending in parallel to the winding mandrel.

Here the system can additionally exhibit at least one conveyor for transporting the goods stack to and from.

The invention also concerns a method for inserting an aperture in a part-region of a film wrapping of a goods stack, preferably arranged on a pallet, where the film wrapping comprises a film hood drawn over the goods stack and possibly a bottom film sheet arranged underneath the goods stack or the film wrapping comprises a film sleeve surrounding the goods stack at least in part and possibly a bottom film sheet arranged underneath the goods stack, a) Where the film wrapping is welded with a bottom film sheet situated underneath the goods stack, forming a weld seam encircling the goods stack horizontally, and Either The aperture is inserted in the weld seam
   or else The aperture is inserted in the region of the bottom film sheet surrounding the goods stack, preferably adjacent to the weld seam, or b) Where the film wrapping exhibits a collar shrinkage encircling the goods stack horizontally, preferably oriented horizontally, and the aperture is inserted in the collar shrinkage or c) Where the film wrapping exhibits a collar stretch encircling the goods stack horizontally, preferably oriented horizontally, and the aperture is inserted in the collar stretch, by means of a device comprising a piercing element with a piercing region and at least one actuation arm, on which the piercing element is mounted rotatably about a rotation axis, where the film hood is pulled away from the goods stack and held in the pulled-away position, where the piercing element is inserted between the goods stack and the film wrapping through an insertion aperture and subsequently the piercing element is displaced downward, such that with its piercing region it inserts an aperture.

A film sleeve is configured as open above and below. A film hood encloses a goods stack on five sides in total. The film hood can involve a shrinkage or stretch hood made of film. If a goods stack is set down directly on a pallet, then for good securing of the load the film hood preferably envelops with its lower encircling margin a part-region of the pallet. In the case of a shrinkage hood, the lower marginal region is heated, forming what is known as a collar shrinkage. In the case of a stretch film, the stretched film hood is slipped over in such a way that the stretch film abuts on the pallet, forming a collar stretch at least in the upper region.

Both in the region of the collar stretch and that of the collar shrinkage, several film layers lie over each other. Therefore, these regions are significantly thicker and in part also firmer than the rest of the regions of the film hood. The collar stretch and the collar shrinkage abut tightly and tautly on the outside of the upper board of the pallet.

If wrapping a goods stack on six sides in total is intended, a bottom film sheet is first laid on a pallet and the goods stack placed on it. After drawing the film hood over the goods stack, the film hood is welded with the bottom film sheet all round, forming a weld seam. In the case of a weld seam, film removal is hindered for example by heavy material accumulation, e.g. in the form of bulges made of molten and resolidified synthetic, or a bottom film sheet which is thick compared with the film hood, or a bottom film sheet welded with several film hoods.

For later unpacking, i.e. film removal, the film hood has to be separated vertically in at least one place so that subsequently the film hood can be pulled off. In goods stacks packaged in this manner, however, automated film removal is hampered because of the weld seam or the collar shrinkage or the collar stretch. In this region the film hood is attached strongly to the contour of the pallet, such that in this region it is not accessible to known film removal methods. Depending on the deployed thickness of the film, for example for the bottom film sheet and for the film hood, the weld seam and/or the film bulge respectively made of welded film material created during welding can be so strong and thick that with the devices known thus far, clean separation of the film hood with the weld seam and/or the film bulge respectively from the bottom film sheet is not possible.

For film removal, therefore, first the weld seam or the collar shrinkage or the collar stretch has to be provided with an aperture, so that the weld seam or the collar shrinkage or the collar stretch is open in one place. To this end, a device is used which comprises an actuation arm to which a rotatably mounted piercing element with a piercing region is attached. The piercing element is inserted between the goods stack and the film hood through an insertion aperture. In order to facilitate the insertion, the film hood in the side region concerned is first pulled away from the goods stack and held in the pulled-away position. After inserting the piercing element into the gap, the piercing element is moved vertically downward.

By means of such a known device, an aperture can indeed be inserted. However, the inserted aperture is not situated in the region of the weld seam or the collar shrinkage or the collar stretch, but rather at a distance from the weld seam or the collar shrinkage or the collar stretch within the lateral surface of the film hood. As a result, part of the film hood remains on the pallet. So that automated film removal can take place, cost- and time-intensive manual post-processing is required. Otherwise problems can occur during subsequent procedures, such as e.g. during transportation, during depalletizing, and during storage, for example in high-rack warehouses, if the residual parts of the film hood are not removed.

The task of the invention, therefore, is to avoid the aforementioned drawbacks and propose a method by means of which an aperture can be inserted in a weld seam, in a region of a bottom film sheet surrounding the goods stack, in a collar stretch, or in a collar shrinkage of a film wrapping.

This task is solved by the piercing element exhibiting a first part-region and a second part-region, where the first part-region is attached, preferably rotatably, to the actuation arm and where the second part-region exhibits the piercing region and where the second part-region is pivotable relative to the first part-region from an original position against a restoring force, and the second part-region is pivoted through travelling along the inside of the film wrapping during the downward displacement against the restoring force in the direction of the goods stack and as a result of the deflection of the second part-region the piercing element with its piercing region strikes the weld seam to be pierced or the region to be pierced of a bottom film sheet surrounding the goods stack or the collar shrinkage to be pierced or the collar stretch to be pierced.

The film hood configured as film wrapping, or the film sleeve configured as film wrapping and surrounding the goods stack at least in part, extends at least to the bottom edge of the goods stack. The film wrapping can, however, also project on the underside relative to the underside of the goods stack. Such configuration can be useful when the goods stack is set down on a pallet and a collar shrinkage enveloping the pallet is provided.

The collar shrinkage and/or the collar stretch respectively can abut tightly and tautly on the outside of the goods stack or of a pallet. In such a case, the collar shrinkage and/or the collar stretch respectively are oriented vertically. It is, however, also quite possible for the collar shrinkage or the collar stretch to engage from underneath a part-region of the pallet, for example the marginal region of the upper board layer of the pallet. In that case, the collar shrinkage and/or the collar stretch respectively is at least in part also oriented horizontally.

According to the method, the film wrapping is pulled away from the goods stack at least in certain areas in the region of the side where an aperture is to be inserted and held in the pulled-away position. Towards the pallet, the pulled-away film wrapping increasingly approaches the goods stack again. In this way there is created free space between the goods stack and the film wrapping. The piercing element is inserted into the gap via an insertion aperture and displaced downward through a vertical movement. During this downward displacement, the first part-region remains in a vertical plane spanned by the downward movement. Due to the pivotable configuration of the second part-region, from now on the second part-region follows the contour of the film wrapping pulled away from the goods stack. To this extent the second part-region travels along the inside of the film wrapping. Thereby the film wrapping guides the second part-region to this extent exactly to the desired region, i.e. the weld seam, the region of a bottom film sheet surrounding the goods stack, the collar shrinkage, or the collar stretch, where the aperture is to be inserted by means of piercing. Thereby it is ensured that after the subsequent removal of the film wrapping, there remain no more remnants of the film wrapping hanging down at the pallet.

After the piercing of the weld seam or of the region of a bottom film sheet surrounding the goods stack or of the collar shrinkage or of the collar stretch, the film wrapping can be pulled away from the goods stack in the region of the pierced aperture in order to enlarge the pierced aperture. Hereby an aperture of greater length is effected.

The film wrapping, including any weld seam that may still be joined with the lower margin of the film wrapping or including any film bulge of welded film material that may still be joined with the lower margin of the film wrapping, can be pulled away from the film stack through a displacement of the piercing element from the goods stack in the region of the pierced aperture.

It may be useful if after the piercing of the weld seam or of the region of a bottom film sheet surrounding the goods stack or of the collar shrinkage or of the collar stretch, the device by means of a suitable cutting blade and a further displacement, preferably a further downward displacement, cuts vertically through any material accumulation that may remain at the lower margin of the film wrapping. The material accumulation that may remain can involve, for example, the weld seam still joined with the lower margin of the film wrapping or the film bulge of welded film material still joined with the lower margin of the film wrapping.

In this process, at least one, preferably rectangular, film flap can first be separated out from the film wrapping on the side of the goods stack at which an aperture is to be inserted, forming an insertion aperture, the film flap attached to a winding mandrel and the film wrapping pulled away from the goods stack and held in the pulled-away position. Subsequently, the piercing element can be inserted between the goods stack and the film wrapping through the insertion aperture thus created. In order to separate out a film flap, for example three incisions forming a U can be made in the film wrapping. In this way, a rectangular film flap is separated out from the film wrapping.

For later removal of the film wrapping, after piercing on the side of the goods stack in which the aperture has been inserted, the film wrapping can be cut open vertically, the winding mandrel guided around the goods stack, and in this process the film wrapping wound on the winding mandrel which is rotating about its longitudinal axis.

The film wrapping wound on the winding mandrel can, after complete winding, be stripped off the winding mandrel by means of at least one transfer device and transported to a waste disposal site. Then the winding mandrel is available for a new film removal process.

BRIEF DESCRIPTION OF THE DRAWINGS

In the following, the embodiment examples of the invention depicted in the drawings are elucidated. The drawings show.

DETAILED DESCRIPTION OF THE PREFERRED EMBODIMENT(S)

In all the drawings, consistent reference labels are used for identical and/or similar respectively components.

Figure 1B:
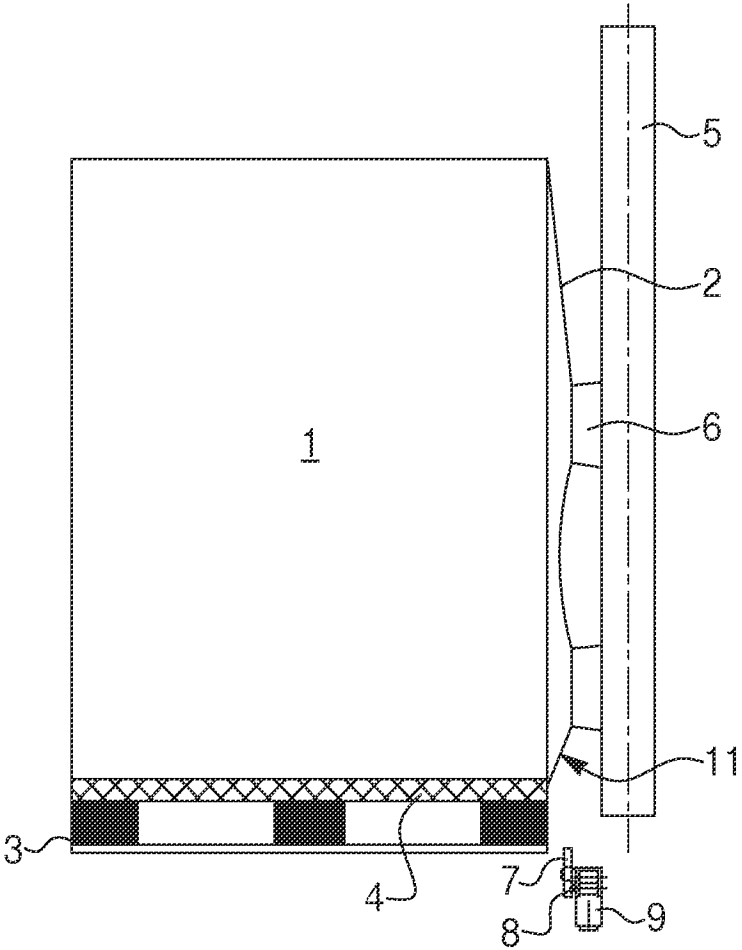
FIG. 1*a* A side view of a goods stack with a film hood drawn over it with a collar shrinkage, where an aperture has been pierced in the film hood by means of a known device, FIG. 1*b* The object in accordance with FIG. 1*a*, where the device has been moved back again to its starting position, FIG. 2*a-f* The course of movement of the invention's device, FIG. 3*a-c* A plan view of the piercing element of the invention's device, a first side view in the original position, and a second side view in the pivoted position, FIG. 4*a*+*b* Two side views of a packaged goods stack, where two film flaps have already been separated out and the film flaps in FIG. 4*a* are clamped by a winding mandrel, FIG. 5*a-c* The elevating of the piercing element, where drawing a) depicts a side view of the front side of the goods stack, drawing b) a side view of the longitudinal side of the goods stack, and drawing c) a plan view, FIG. 6*a-c* The insertion of the piercing element into the insertion aperture, where drawing a) depicts a side view of the front side of the goods stack, drawing b) a side view of the longitudinal side of the goods stack, and drawing c) a plan view, FIG. 7*a-c* The position of the piercing element shortly before piercing, where drawing a) depicts a side view of the front side of the goods stack, drawing b) a side view of the longitudinal side of the goods stack, and drawing c) a plan view, FIG. 8 The detail "X" from FIG. 7*a,*
Figure 1A:
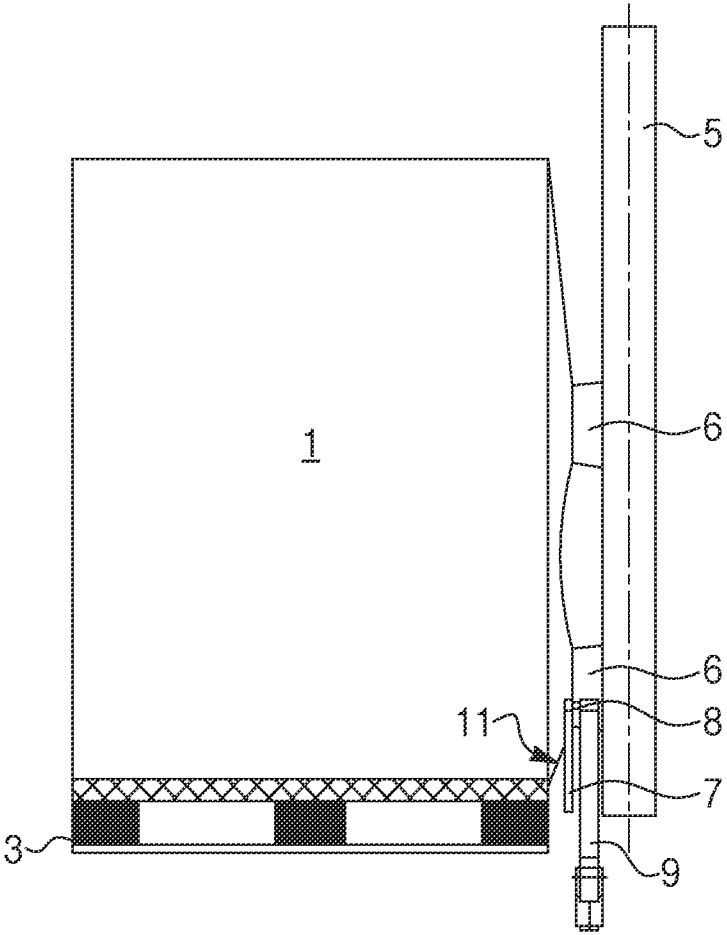
Figure 2A:
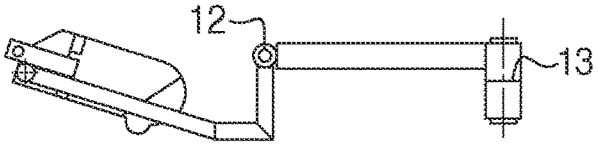
Figure 2B:
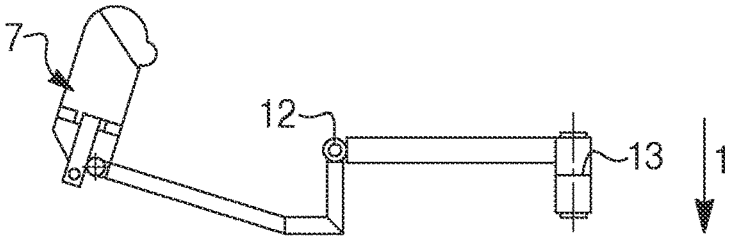
Figure 2C:
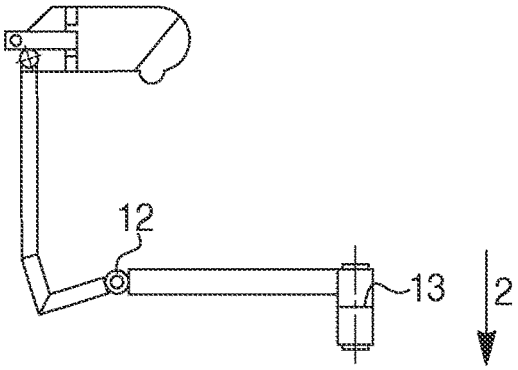
Figure 2D:
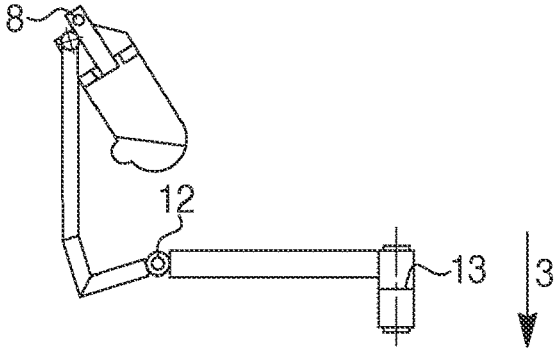
Figure 2E:
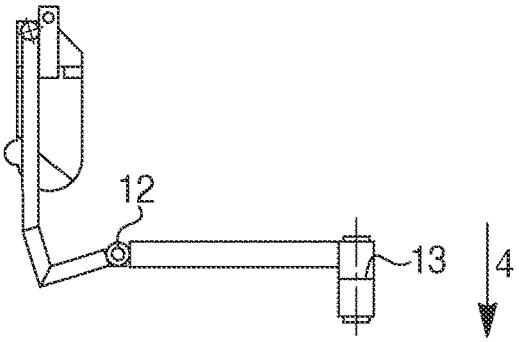
Figure 2F:
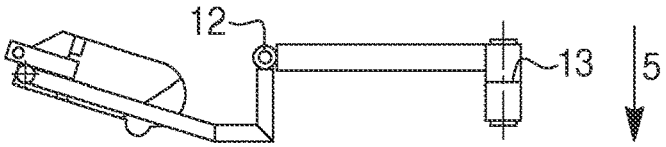

FIGS. 1*a* and 1*b* show a goods stack 1, over which a film hood 2 is drawn as film wrapping. The goods stack 1 is arranged on a pallet 3. The lower margin of the film hood 2 forms a horizontally oriented collar shrinkage 4, which arises during shrinking of the relevant region. The collar shrinkage 4 abuts on the pallet 3 tautly and tightly. The collar shrinkage 4 engages the marginal region of the upper board layer of the pallet 3 from underneath. A collar shrinkage 4 involves a material accumulation of welded film material.

Laterally adjacent to the goods stack 1 there is depicted a winding mandrel 5. As can be seen in the drawings, on one side of the film hood 2 there have been cut out by means of three incisions each two film flaps 6 which are attached to the winding mandrel 5. After attaching the film flaps 6, the film hood 2 is pulled away slightly from the goods stack 1 by means of the winding mandrel 5.

Each of the two film flaps 6 cut out on three sides constitutes an insertion aperture. Through the lower insertion aperture there is inserted part of a device for inserting an aperture. As can be seen in FIGS. 1*a* and 1*b*, the device exhibits a blade-like piercing element 7 which is attached rotatably about a rotation axis 8 to an actuation arm 9 of the device. The mounting of the actuation arm 9 is not depicted in further detail.

In the region of the end facing downward in FIGS. 1*a* and 1*b*, the piercing element 7 exhibits a piercing region 10. The arranged of the piercing region 10 is depicted as an example in FIGS. 3*a* and 3*b*, which show the piercing element 7 in an enlarged depiction. After the insertion of the piercing element 7 into the insertion aperture, the piercing element 7 is displaced downward. During the downward displacement the piercing element 7 is guided at a distance from the goods stack 1 and strikes the taut film hood 2. In the contact region, the piercing element 7 inserts an aperture 11.

As can be seen in FIG. 1*b*, however, the aperture 11 is inserted at a distance from the collar shrinkage 4 which directly abuts the pallet 3. Therefore, a part of the film hood 1 remains at the collar shrinkage 4. After complete unpacking, this remaining part hangs down and can, for example, cover the free space between two runners of the pallet 3.

FIGS. 2*a* to 2*f* and 3*a* to 3*c* show the invention's device for inserting an aperture 11 in a weld seam oriented horizontally between a bottom film sheet and a film hood welded with the bottom film sheet and drawn over a goods stack or for inserting an aperture in a horizontally oriented collar shrinkage 4 or in a horizontally oriented collar stretch of a film hood 2 drawn over a goods stack 1 arranged on a pallet 3. A goods stack 1 covered with a film hood 2 and set down on a pallet 3 is depicted as an example in FIG. 1*a*.

The device comprises a piercing element 7 with a piercing region 10 and an actuation arm 9. In the depicted embodiment example, the actuation arm 9 is configured in two parts, where the two parts of the actuation arm 9 are connected with one another by means of a a rotary joint 12. If the device is arranged adjacent to a conveyor on which the goods stacks 1 to be unpacked are transported, the actuation arm 9 can for example be installed on the structure of the conveyor. To further modify the tilt of the actuation arm 9, a rotary bearing 13 is provided. To modify the distance between the piercing element 7 and the pallet 3, the rotary bearing 13 can for example be attached on a sled which is oriented orthogonally to the longitudinal side of the goods stack 1. Thereby the device can be moved in the direction of the arrow 14 marked in FIG. 11*b* nearer to the goods stack 1 or moved away from it.

The piercing element 7 exhibits a first part-region 15 and a second part-region 16, where the first part-region 15 is mounted rotatably around the rotation axis 8 on the actuation arm 9 and the second part-region 16 exhibits the piercing region 10. In the depicted embodiment example, the first part-region 15 and the second part-region 16 are connected pivotably with each other via a spring joint 17.

The first part-region 15 exhibits a laterally projecting guide pin 18, on which a transfer element 19 is guided which is bolted to the second part-region 16. On the guide pin 18 there is furthermore mounted a spring 20 and secured with a bolt 21. The spring 20 pushes the transfer element 19 against the first part-region 15.

Figure 3A:
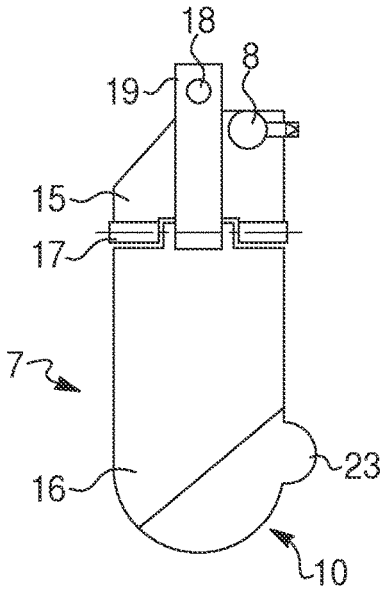
Figure 3B:
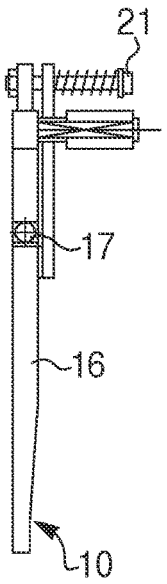
Figure 3C:
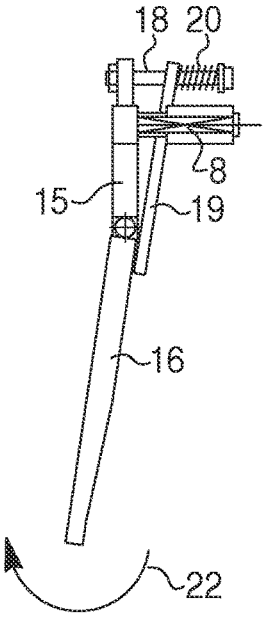

FIG. 3*b* depicts the device in the original position. In the original position, the first part-region 15 and the second part-region 16 are in alignment. The second part-region 16 can be pivoted from this original position relative to the first part-region 15 in the direction of the arrow 22 against the restoring force generated by the spring 20. The pivoted position of the second part-region 16 is depicted in FIG. 3*c*.

As can be seen in FIGS. 3*a* and 3*b*, the edge of the second part-region 16 is configured as beveled in the region of the free end, namely beveled in the direction in which the second part-region 16 is pivotable against the restoring force. The free end of the second part-region 16 exhibits an approximately rounded configuration. In addition, the free end of the second part-region 16 exhibits in the piercing region 10 an overhang 23 projecting relative to the edge, which in the depicted embodiment example is configured as approximately semi-circular.

Figure 12A:
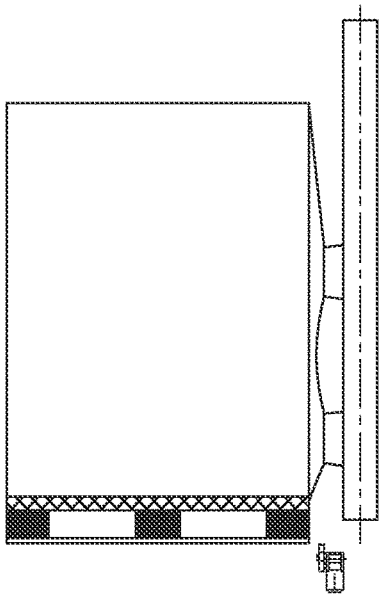
Figure 12B:
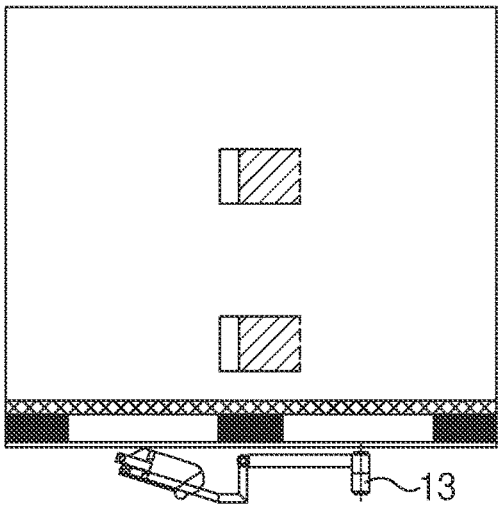
Figure 12C:
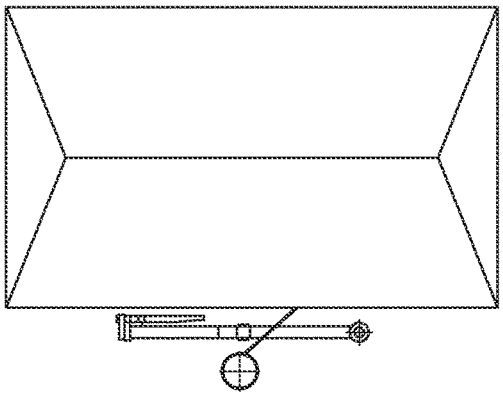
Figure 12D:
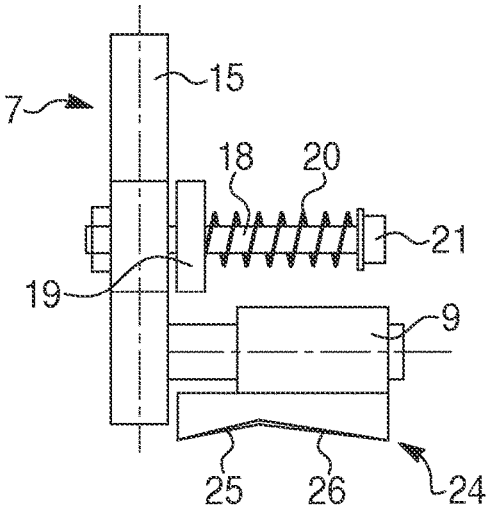

As can be seen for example in FIG. 12*d*, the actuation arm 9 exhibits adjacent to the rotation axis 8, about which the piercing element 7 is mounted rotatably, a cutting blade 24 extending in parallel to the rotation axis 8 and oriented orthogonally to the actuation arm 9, arranged at the actuation arm 9 in such a way that during further downward movement after piercing, the cutting blade 24 is arranged on the underside of the actuation arm 9. The cutting blade 24 is formed by two cutting blade part-regions 25, 26 oriented obliquely to one another and forming between them a funnel-shaped insertion region.

The invention's method is depicted in FIGS. 4 to 12, where the devices necessary for unpacking are only implied. As can be seen for example in FIG. 4*a*, two U-shaped incisions are inserted in the film hood 2 in the region of a longitudinal side by means of a separating device which is not depicted. The separating device can involve, for example, a U-shaped heated wire. In the region of each U-shaped incision, a rectangular film flap 6 is hereby separated out. The film flaps 6 are taken in, for example by means of a suction device, and attached to a winding mandrel 5.

Figure 4A:
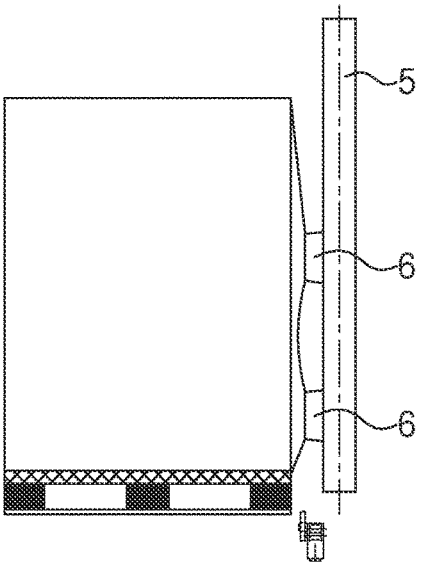
Figure 4B:
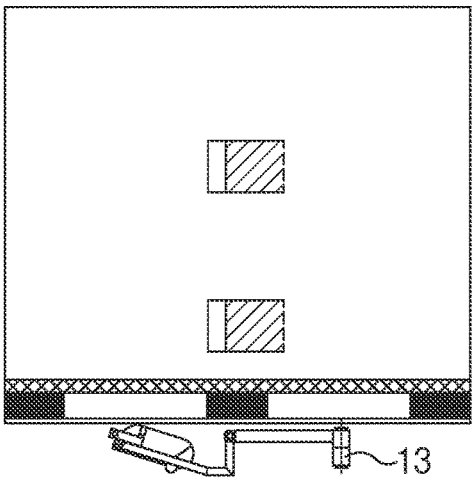

In FIG. 4 the invention's device is still situated in it starting position. In the depicted embodiment example, in the starting position the device is situated underneath the plane of the pallet.

Figure 5A:
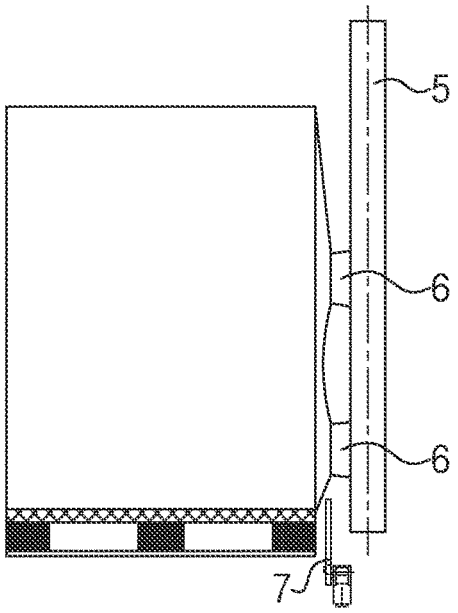
Figure 5B:
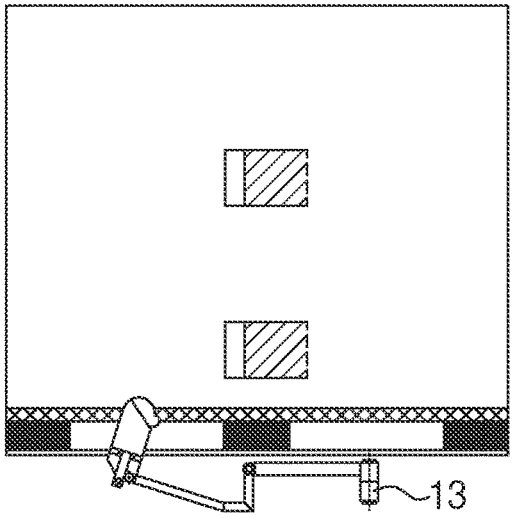
Figure 5C:
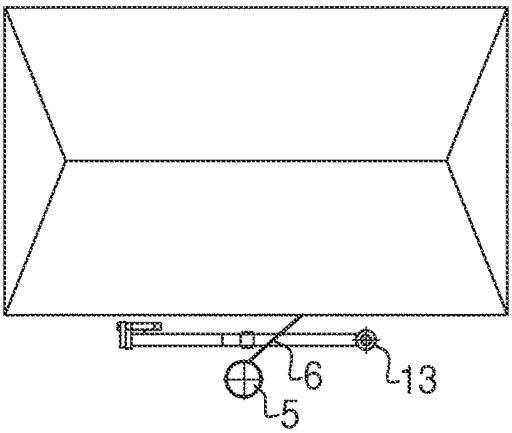
Figure 6A:
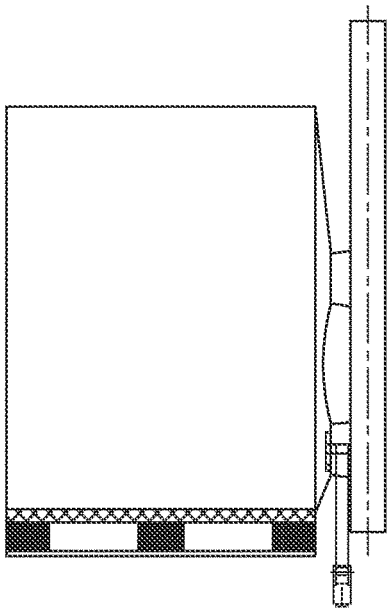
Figure 6B:
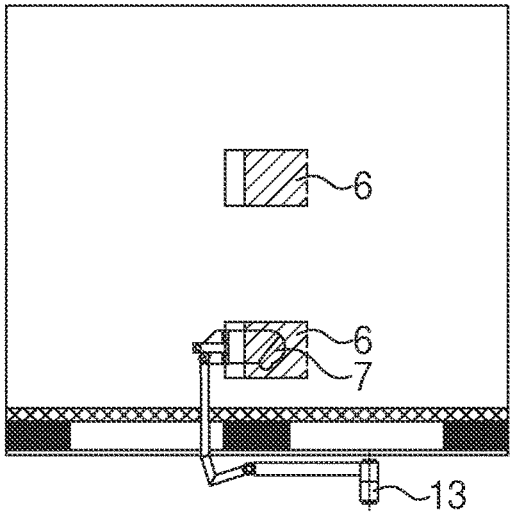
Figure 6C:
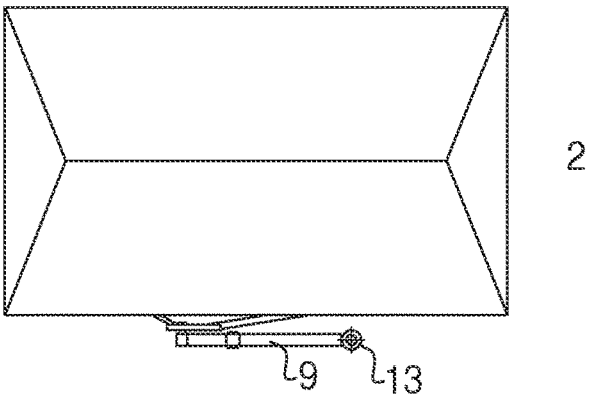

In FIG. 5 the piercing element 7 has already been raised. As depicted in FIG. 6, the part of the actuation arm 9 at which the piercing element 7 is attached is then pivoted. The piercing element 7 is thereby inserted through the insertion aperture into the gap between the goods stack 1 and the film hood 2.

Figure 7A:
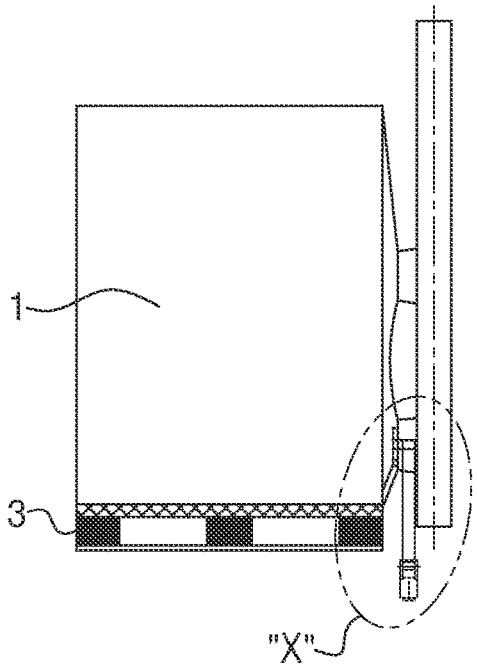
Figure 7B:
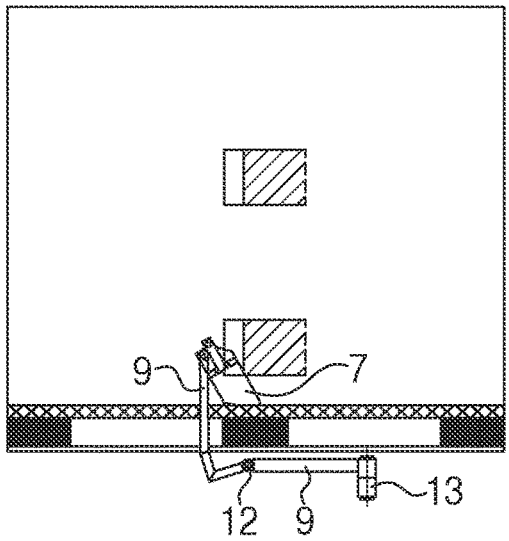
Figure 7C:
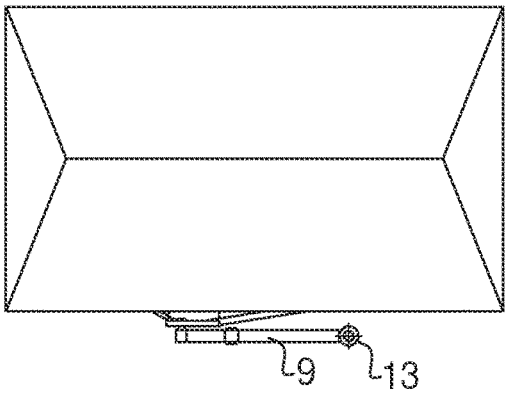
Figure 8:
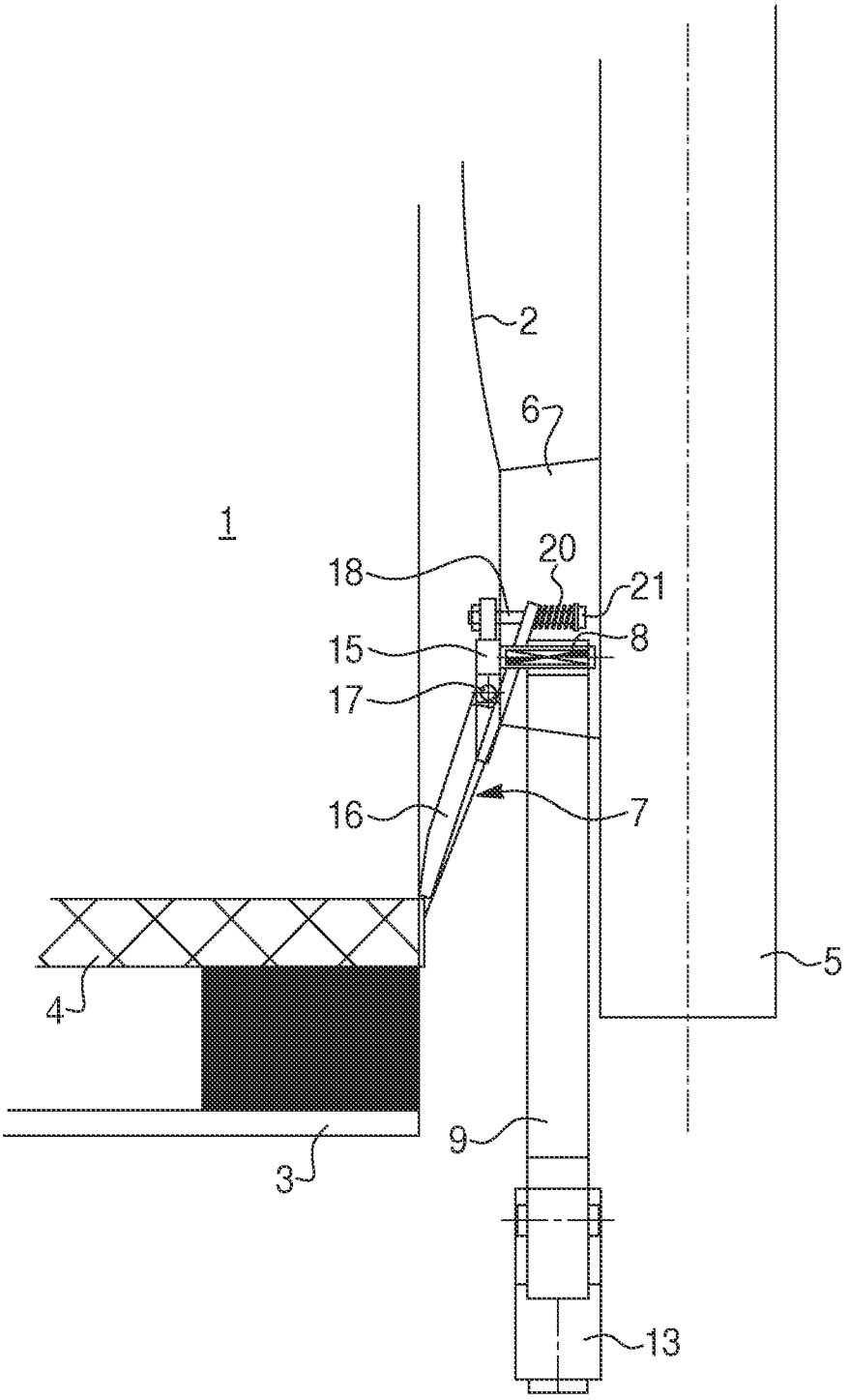

The piercing element 7 is situated thereby at a horizontal distance from the goods stack 1, as depicted for example in FIG. 7*a*. Subsequently the piercing element 7 is pivoted downward about the rotation axis 8. During this downward displacement, the piercing element 7 travels along the inside of the film hood 2. Due to the pivotable mounting of the second part-region 16 on the first part-region 15, the second part-region 16 is pivoted more and more into the position depicted in FIG. 8, whereas the first part-region 15 is displaced solely vertically downward. As a result, the piercing element 7 with its piercing region 10 strikes exactly the region to be pierced, in the present case the collar shrinkage 4.

Figure 9A:
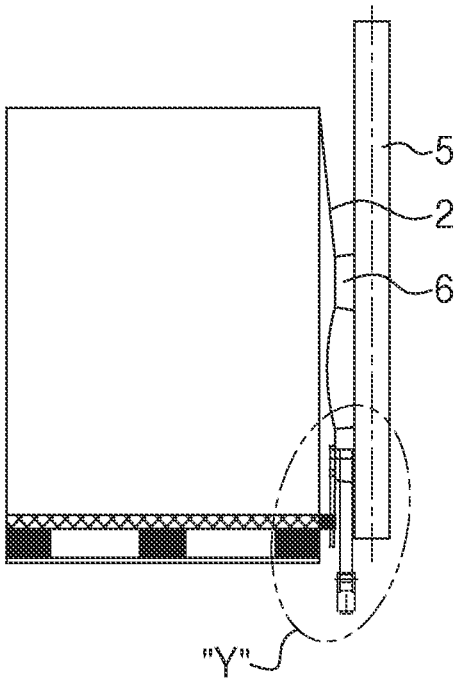
FIG. 9*a-c* The position of the piercing element after piercing, where drawing a) depicts a side view of the front side of the goods stack, drawing b) a side view of the longitudinal side of the goods stack, and drawing c) a plan view, FIG. 10*a-b* The detail "Y" from FIG. 9*a* and a plan view of the detail "Y" from FIG. 9*a,*
Figure 9B:
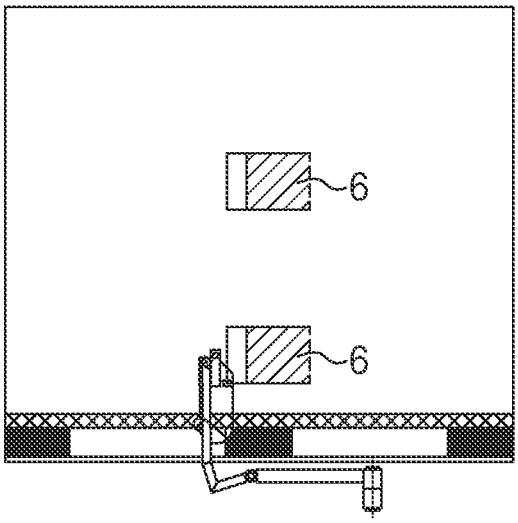
Figure 9C:
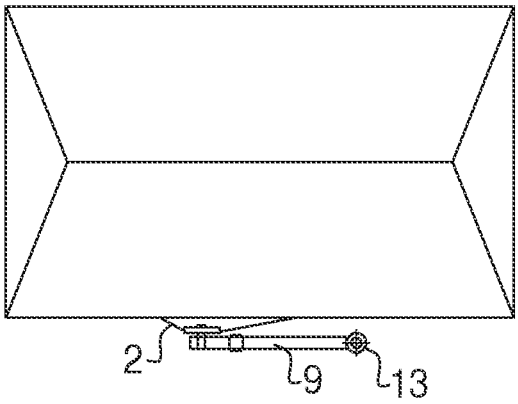
Figure 10A:
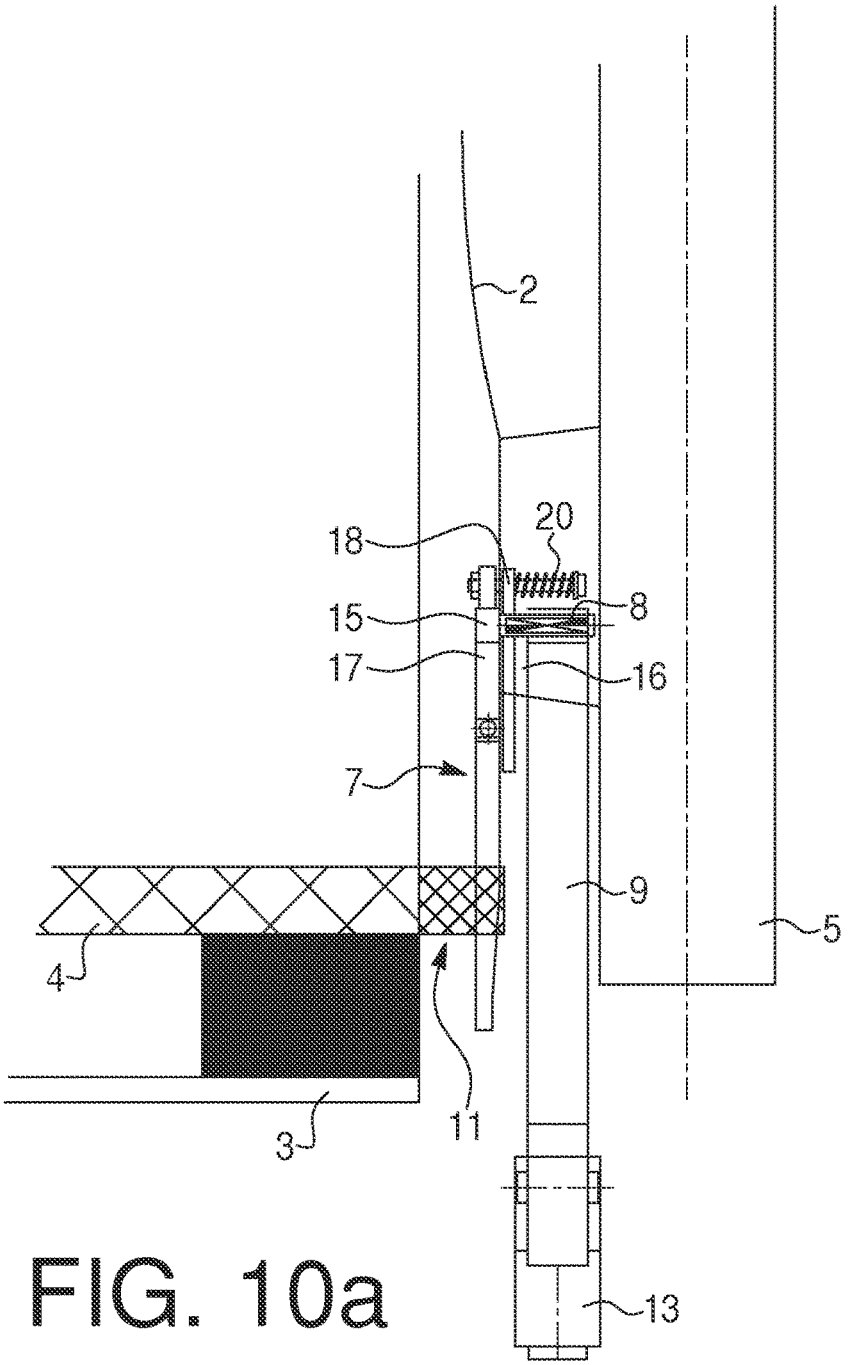
Figure 10B:
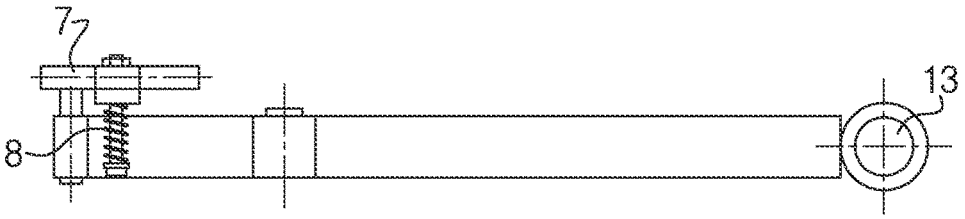

In FIG. 9, the piercing element 7 has already inserted the desired aperture 11 in the collar shrinkage 4. Therefore the piercing element 7 stands out partially from under the film hood 2. FIG. 10*a* shows the detail "Y" from FIG. 9*a* and FIG. 10*b* a plan view of the detail "Y" from FIG. 9*a*. As can be seen in the drawings, the aperture 11 has already been inserted. The piercing element 7 stands out underneath. Since the aperture 11 has been inserted and thereby the film hood 2 is no longer taut in this region, the spring 20 has pivoted the second part-region 16 back to the original position.

Figure 11A:
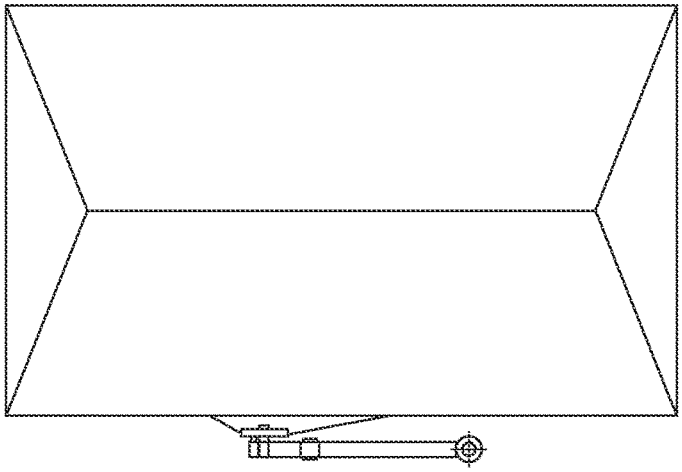
FIG. 11*a-c* Two plan views of the goods stack, where the piercing element is moved away from the goods stack in order to enlarge the length of the aperture, and the device in an enlarged depiction in plan view, FIG. 12*a-c* The position of the piercing element after movement into its starting position, where drawing a) depicts a side view of the front side of the goods stack, drawing b) a side view of the longitudinal side of the goods stack, and drawing c) a plan view, and FIG. 12*d* A plan view of s part-region of the device, where in this position the piercing element is oriented in parallel to the actuation arm.
Figure 11B:
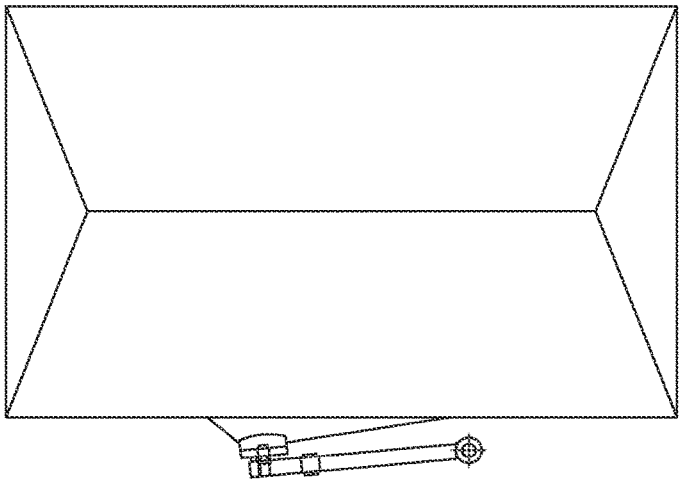
Figure 11C:
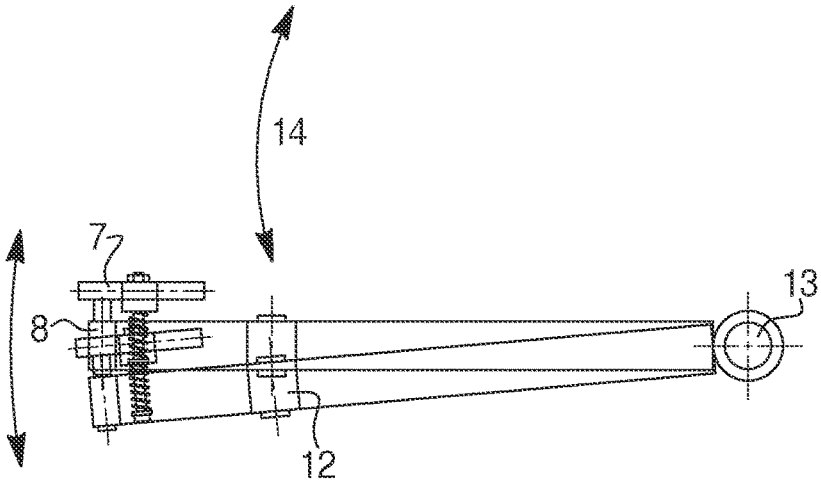

In FIGS. 11*b* and 11*c*, in order to enlarge the pierced aperture 11 the actuation arm 9 is pivoted outward and thereby the piercing element 7 is displaced horizontally away from the goods stack 1. As a result, the film hood 2 is pulled away from the goods stack 1 in the region of the pierced aperture 11 and thereby the aperture 11 is enlarged.

In FIGS. 12*a* to 12*d*, the invention's device has again been displaced back to its starting position, as depicted in FIG. 4. By means of the cutting blade 24 which is recognizable in FIG. 12, after the piercing of the collar shrinkage 4 or of a collar stretch the device can during a further downward displacement cut vertically through residues of any remaining material accumulation in the lower margin of the film hood 2.

This is followed by the film removal. To this end, after the piercing on the side of the goods stack 1 in which the aperture has been inserted the film hood 2 is cut open vertically.

The winding mandrel 5 is then guided around the goods stack 1. Thereby the film hood 2 is wound on the winding mandrel 5 which is rotating about its longitudinal axis.

The invention claimed is:

1. A device for forming an aperture (11) into a part-region of a film wrapping of a goods stack (1) arranged on a pallet, where the film wrapping comprises a film hood (2) drawn over the goods stack (1) and a bottom film sheet arranged underneath the goods stack (1) or a film sleeve surrounding the goods stack (1) at least in part and the bottom film sheet arranged underneath the goods stack (1), the film wrapping is welded with the bottom film sheet situated underneath the goods stack (1), forming a weld seam horizontally encircling the goods stack (1), the device comprising:

a piercing element (7) with a piercing region (10), the piercing element (7) comprising a first part-region (15) and a second part-region (16); and an actuation arm (9) to which the piercing element (7) is attached rotatably about a rotation axis (8);

wherein the first part-region (15) is mounted rotatably on the actuation arm (9) and the second part-region (16) comprising the piercing region (10), the second part-region (16) is pivotably connected to the first part-region (15) by a spring joint;

wherein the piercing element is configured to be inserted between the goods stack and the film wrapping such that the first part-region is oriented along a vertical plane and the second part-region is configured to pivot about the spring joint from an original position in the vertical plane against a restoring force of the spring joint into an orientation assuming a contour of the film wrapping pulled away from the goods stack and form the aperture; and wherein the aperture (11) is formed in one of the weld seam, a region of the bottom film sheet surrounding the goods stack (1), a collar shrinkage (4) defined by the film wrapping and encircling the goods stack (1) horizontally, and a collar stretch defined by the film wrapping and encircling the goods stack (1) horizontally.

2. The device according to claim 1, wherein the piercing element (7) is configured as a cutting blade.

3. The device according to claim 1, wherein an edge of a free end of the second part-region (16) is configured at least in part as beveled or rounded in a direction in which the second part-region (16) is pivotable against the restoring force.

4. The device according to claim 1, wherein an edge of a free end of the second part-region (16) and/or a surface of the second part-region (16) interacting with an inside of the film hood (2) has a friction-minimizing coating and/or friction-minimizing surface.

5. The device according to claim 1, wherein a free end of the second part-region (16) comprises in the piercing region (10) an overhang (23) projecting relative to an edge.

6. The device according to claim 1, wherein the piercing element (7) includes a cutting blade.

7. The device according to claim 1, wherein a cutting blade (24) is formed by two cutting blade part-regions (25, 26) oriented obliquely to each other and forming between them a funnel-shaped insertion region.

8. The device according to claim 1, wherein the piercing element (7) is configured in the manner of a blade.

9. The device according to claim 1, wherein the second part-region (16) is pivotable from the original position relative to the first part-region (15) against the restoring force generated by a spring (20) of the spring joint.

10. A device for forming an aperture (11) into a part-region of a film wrapping of a goods stack (1) arranged on a pallet, where the film wrapping comprises a film hood (2) drawn over the goods stack (1) and a bottom film sheet arranged underneath the goods stack (1) or a film sleeve surrounding the goods stack (1) at least in part and the bottom film sheet arranged underneath the goods stack (1), the film wrapping is welded with the bottom film sheet situated underneath the goods stack (1), forming a weld seam horizontally encircling the goods stack (1), the device comprising:

a piercing element (7) with a piercing region (10), the piercing element (7) comprising a first part-region (15) and a second part-region (16); and an actuation arm (9) to which the piercing element (7) is attached rotatably about a rotation axis (8);

wherein the first part-region (15) is mounted rotatably on the actuation arm (9) and the second part-region (16) comprising the piercing region (10), the second part-region (16) is pivotably connected to the first part-region (15) by a spring joint, wherein the second part-region is pivotable from an original position against a restoring force of the spring joint;

wherein the aperture (11) is formed in one of the weld seam, a region of the bottom film sheet surrounding the goods stack (1), a collar shrinkage (4) defined by the film wrapping and encircling the goods stack (1) horizontally, and a collar stretch defined by the film wrapping and encircling the goods stack (1) horizontally; and wherein in the original position, the second part-region (16) is in alignment with the first part-region.

11. A device for forming an aperture (11) into a part-region of a film wrapping of a goods stack (1) arranged on a pallet, where the film wrapping comprises a film hood (2) drawn over the goods stack (1) and a bottom film sheet arranged underneath the goods stack (1) or a film sleeve surrounding the goods stack (1) at least in part and the bottom film sheet arranged underneath the goods stack (1), the film wrapping is welded with the bottom film sheet situated underneath the goods stack (1), forming a weld seam horizontally encircling the goods stack (1), the device comprising:

a piercing element (7) with a piercing region (10), the piercing element (7) comprising a first part-region (15) and a second part-region (16); and an actuation arm (9) to which the piercing element (7) is attached rotatably about a rotation axis (8);

wherein the first part-region (15) is mounted rotatably on the actuation arm (9) and the second part-region (16) comprising the piercing region (10), the second part-region (16) is pivotably connected to the first part-region (15) by a spring joint, wherein the second part-region is pivotable from an original position against a restoring force of the spring joint;

wherein the aperture (11) is formed in one of the weld seam, a region of the bottom film sheet surrounding the goods stack (1), a collar shrinkage (4) defined by the film wrapping and encircling the goods stack (1) horizontally, and a collar stretch defined by the film wrapping and encircling the goods stack (1) horizontally; and wherein the actuation arm is positioned adjacent to the rotation axis (8) about which the piercing element (7) is mounted rotatably, and wherein at least one cutting blade (24) extending parallel to the rotation axis (8) and oriented orthogonally to the actuation arm is arranged in such a way at the actuation arm (9) that the at least one cutting blade (24) is arranged after piercing on a side facing downward of the actuation arm (9).

12. The device according to claim 11, wherein the at least one cutting blade (24) is formed by two cutting blade part-regions (25, 26) oriented obliquely to each other and forming between them a funnel-shaped insertion region.

13. A system comprising a film wrapping and a goods stack (1) arranged on a pallet with the film wrapping, where the film wrapping comprises a film hood (2) drawn over the goods stack (1) and a bottom film sheet arranged underneath the goods stack (1) or a film sleeve surrounding the goods stack (1) at least in part and the bottom film sheet arranged underneath the goods stack (1), a) where the film wrapping is welded with bottom film sheet situated underneath the goods stack (1), forming a weld seam encircling the goods stack (1) horizontally, an aperture (11) is formed in the weld seam or in a region of the bottom film sheet surrounding the goods stack, or b) where the film wrapping comprises a collar shrinkage (4) encircling the goods stack (1) horizontally, and the aperture (11) is formed in the collar shrinkage (4) or c) where the film wrapping comprises a collar stretch encircling the goods stack (1) horizontally, and the aperture (11) is formed in the collar stretch, and a device which comprises a piercing element (7) with a piercing region (10) and at least one actuation arm (9) to which the piercing element (7) is attached rotatably about a rotation axis (8), wherein the aperture (11) is formed in one of the weld seam, the region of the bottom film sheet surrounding the goods stack (1), the collar shrinkage (4), and the collar stretch, wherein the piercing element comprises a first part-region and a second part-region;

wherein the first part-region is mounted rotatably on the at least one actuation arm and the second part-region comprises the piercing region, the second part-region is pivotably connected to the first part-region by a spring joint;

wherein the piercing element is configured to be inserted between the goods stack and the film wrapping such that the first part-region is oriented along a vertical plane and the second part-region is configured to pivot about the spring joint from an original position in the vertical plane against a restoring force of the spring joint into an orientation assuming a contour of the film wrapping pulled away from the goods stack and form the aperture.

* * * * *